United States Patent [19]

Enters et al.

[11] 4,123,857

[45] Nov. 7, 1978

[54] DRIVE ARRANGEMENT FOR SNOWBLOWER

[75] Inventors: Edward W. Enters, Fredonia; Roger J. Bacon, Plymouth, both of Wis.

[73] Assignee: Gilson Brothers Company, Plymouth, Wis.

[21] Appl. No.: 764,823

[22] Filed: Feb. 2, 1977

[51] Int. Cl.[2] ..... E01H 5/00

[52] U.S. Cl. ..... 37/43 E; 74/606 R; 74/607; 74/417

[58] Field of Search ..... 37/43 R, 43 A, 43 B, 37/43 C, 43 D, 43 E, 43 F, 43 G, 43 H, 43 I, 43 K, 43 L; 74/606 R, 607, 412 R, 416, 417, 421 R

[56] References Cited

U.S. PATENT DOCUMENTS

| | | | |
|---|---|---|---|
| 426,248 | 4/1890 | Dixon | 74/607 |
| 1,182,067 | 5/1916 | Whittell | 37/43 C |
| 2,614,473 | 10/1952 | Yacoby | 37/43 D |
| 3,054,247 | 9/1962 | Roesler | 37/43 E X |
| 3,148,559 | 9/1964 | Stevens | 74/606 |
| 3,440,740 | 4/1969 | Kamlukin | 37/43 R |
| 3,580,351 | 5/1971 | Mollen | 37/43 E |
| 3,721,025 | 3/1973 | Orr | 37/43 E |
| 3,774,321 | 11/1973 | David | 37/43 L |
| 3,867,773 | 2/1975 | Gunderson | 37/43 R |
| 3,986,414 | 10/1976 | Peterson | 37/43 R |

FOREIGN PATENT DOCUMENTS

| | | | |
|---|---|---|---|
| 569,851 | 2/1959 | Canada | 37/43 R |
| 729,860 | 3/1966 | Canada | 37/43 E |
| 569,851 | 2/1959 | Canada | 37/43 R |
| 283,340 | 9/1952 | Switzerland | 37/43 D |
| 396,570 | 8/1933 | United Kingdom | 74/606 |

*Primary Examiner*—E. H. Eickholt

[57] ABSTRACT

A vertical crankshaft engine is the power source of a snowblower. Two horizontal drive belts extend from a double pulley arrangement on the engine crankshaft. One drive belt extends to the vertical input shaft of the traction gear case to power the snowblower wheels. The other belt extends to the vertical input shaft of a right angle gearbox at one axial end of the collector assembly to transmit rotary motion to the collector assembly. A horizontally pivotal idler pulley selectively tensions the belt providing the motive power for the collector assembly and a clutch assembly is associated with the traction axle assembly to selectively power the snowblower wheels.

The right angle gearbox housing is made in two complementary pieces which are held together by a type of snap ring and when assembled is bolted to one end of the housing of the collector assembly.

3 Claims, 6 Drawing Figures

DRIVE ARRANGEMENT FOR SNOWBLOWER

BACKGROUND OF THE INVENTION

Conventionally, power snowblowers utilize a single engine to power both the traction wheels and collector assembly with various types of drive trains having been used to transmit power to the wheels and collector assembly. Accepted practice has been to utilize an engine with a horizontally oriented crankshaft as the power source.

In relatively smaller size snowthrowers, e.g. single stage snowthrowers, the power input to the collector assembly generally has been at one axial end of the collector assembly. The horizontal crankshaft power sources complicate the design of the snowthrower particularly the smaller type snowthrowers mentioned above. Thus these conventional arrangements offer acceptable design considerations when dealing with larger snowblower assemblies but do become a complication when attempting to reduce the size of the snowblower.

This invention is concerned with those problems and has among its general objects to provide a snowblower which is relatively economical, has a design which is readily fabricated and assembled, and yet affords effective operation.

SUMMARY OF THE INVENTION

For the achievement of these and other objects, this invention proposes a vertical crankshaft engine as the power source of the snowblower. Two drive members, preferably belts, are operatively associated with the crankshaft, one providing the motive force in the traction drive and the other motive force to the collector assembly.

The belt to the traction drive extends in a horizontal plane and is connected, through a pulley-gear case arrangement, to the traction wheel axle. A clutch mechanism operatively associated in the traction drive permits the snowblower to be driven under the control of the operator.

The belt providing the motive force for the collector assembly also extends in a horizontal plane and through a pulley-gear case arrangement, drives the collector auger, of the collector assembly. An idler pulley associated with the belt selectively tensions the belt to establish the drive connection from the power source to the collector assembly.

A right angle gear case is used in the drive for the collector assembly. It has a vertical input shaft which carries a pulley engaged by the belt. The gear case assembly includes a horizontally oriented output shaft driving the shaft of the collector assembly. In accordance with the preferred embodiment of this invention, the right angle gear case is located at one axial end of the collector assembly, being mounted on a sidewall of the collector assembly housing.

The collector assembly gear case is preferably made in two pieces split generally down the middle of the gear case housing. The two complementary pieces of the gear case housing are held together by a form of snap ring which is basically the only fastening for the gear case subassembly. The gear case is also provided with a pair of mounting flanges which are used to bolt the gear case to a collector assembly end wall. This provides a relatively simple and readily assembled gear case and, moreover, takes advantage of the fact that the gear case is located at the end of the collector assembly, i.e. being bolted to the end wall of the collector assembly housing further contributes to the feature that the housing pieces do not have to be directly bolted together as is usual conventional practice.

Other objects and advantages will be pointed out in, or be apparent from, the specification and claims, as will obvious modifications of the embodiment shown in the drawings, in which:

DESCRIPTION OF THE PREFERRED EMBODIMENT

Figure 1:
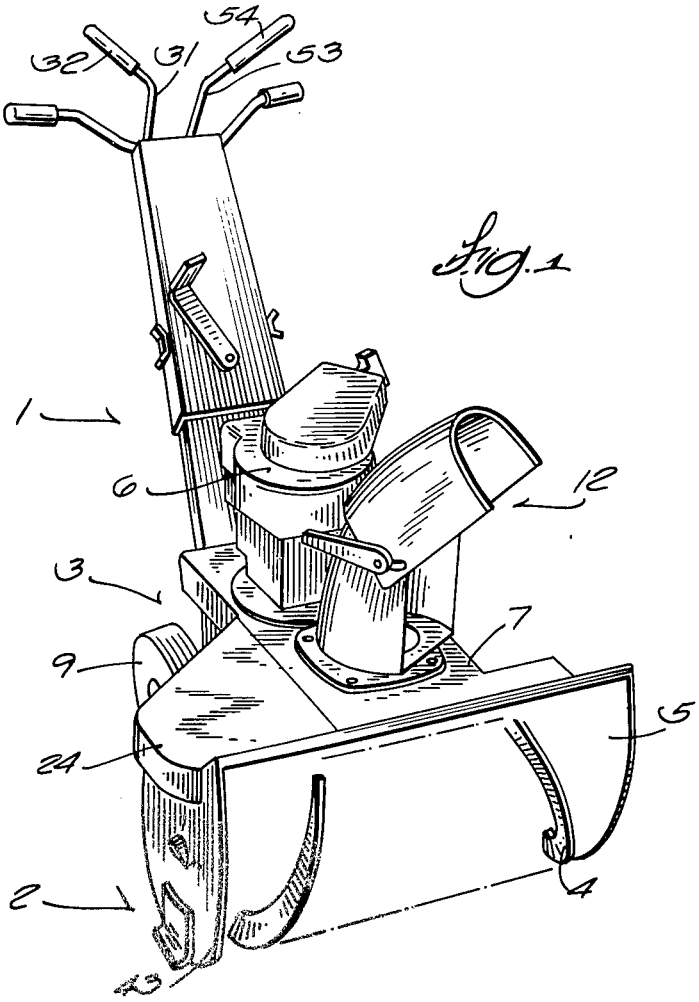
FIG. 1 is a perspective view of a power snowthrower.
Figure 4:
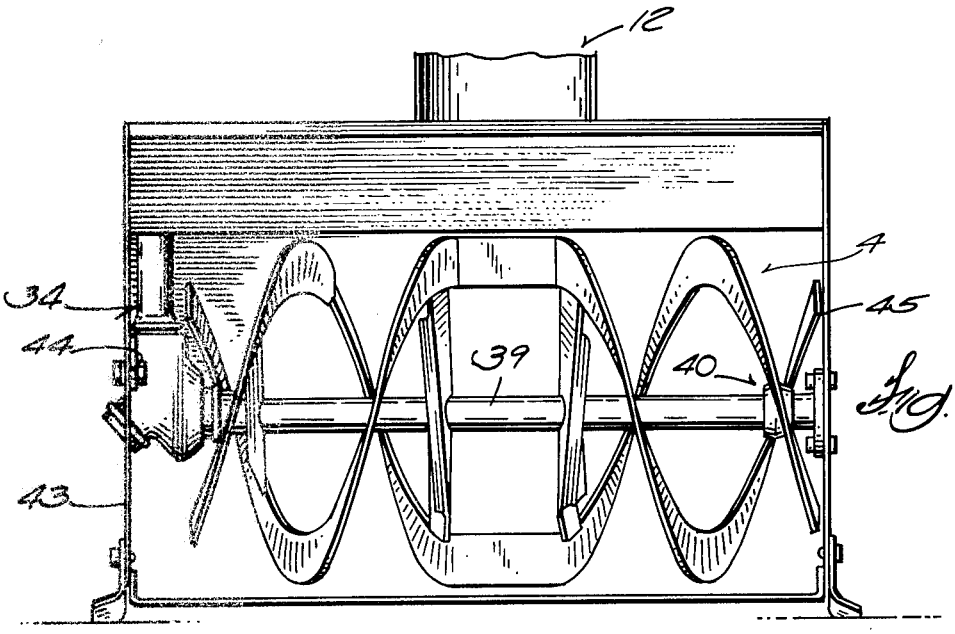
FIG. 4 is an end view looking into the collector housing.
Figure 3:
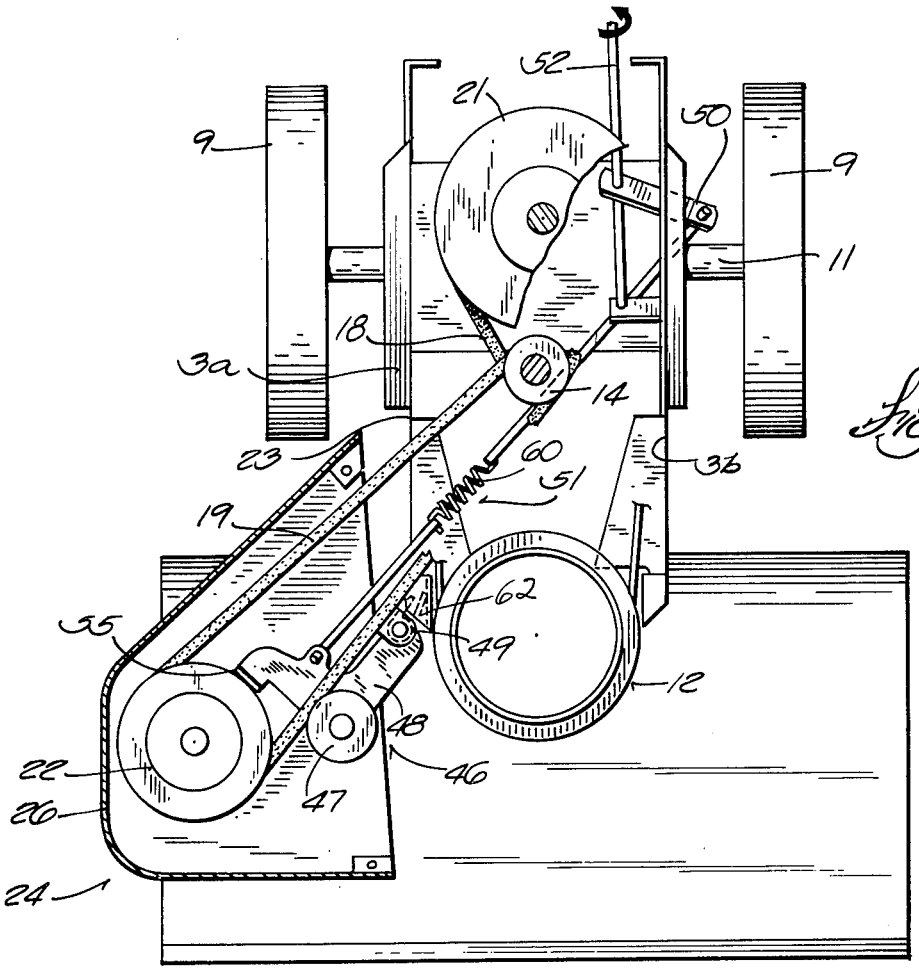
FIG. 3 is a top view of the belt drive.
Figure 2:
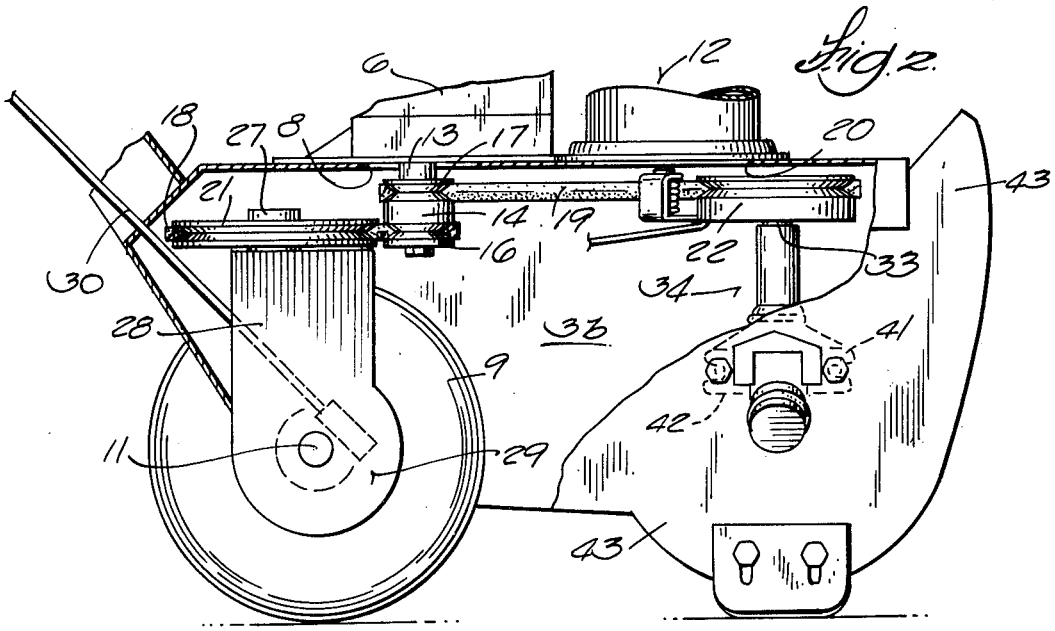
FIG. 2 is an enlarged side view of the lower portion of the snowthrower.
Figure 5:
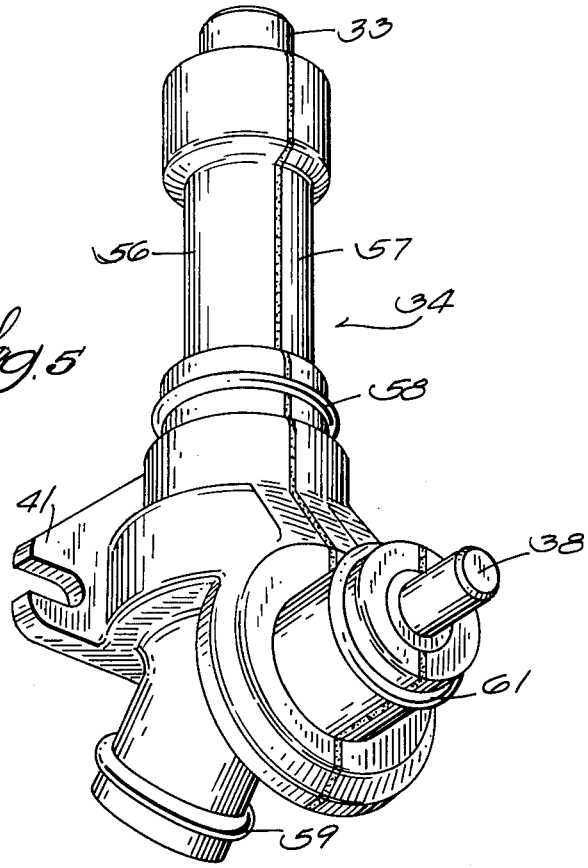
FIG. 5 is a view of the right angle collector drive gear case.
Figure 6:
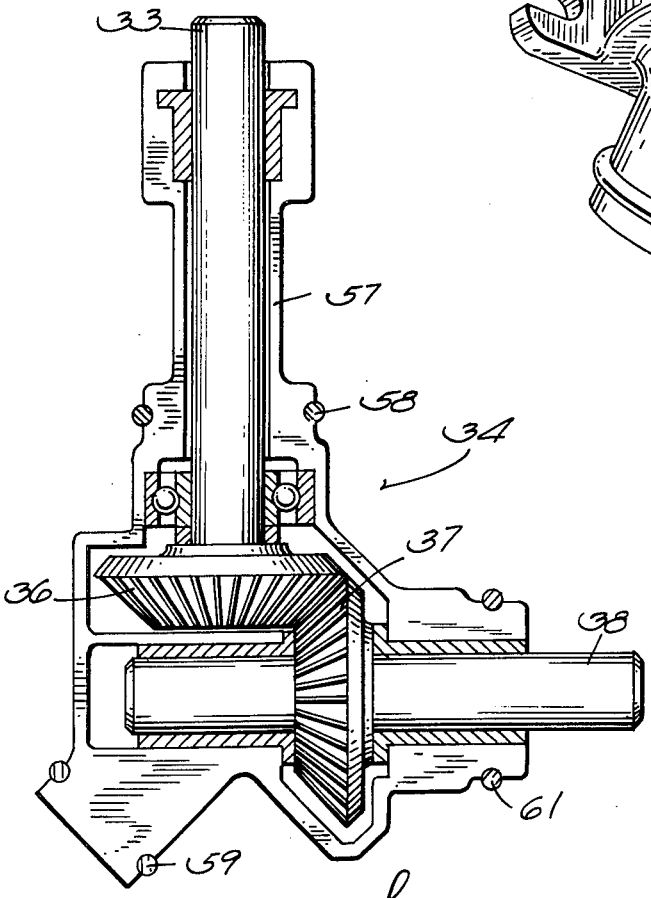
FIG. 6 is a section through the gear case.

With particular reference to the drawings, a power snowthrower is illustrated as including a generally vertical handle 1, a collector assembly 2, and a frame assembly 3 connecting the handle and the collector assembly. The collector assembly includes a collector 4, an auger and shaft, and a housing 5. A shroud 7 is connected to frame 3 and projects from the handle over a portion of the collector assembly housing. Engine 6 is bolted to shroud 7 at opening 8 in a conventional manner. A pair of traction wheels 9 are supported at the rear of frame 3 on an axle assembly 11. A discharge guide 12 is also connected to shroud 7 at opening 18. These elements are generally incorporated in a power snowthrower.

The details of the discharge guide and its control are more particularly disclosed and claimed in the co-pending application of Roger J. Bacon entitled "Snowblower Discharge Guide and Control Arrangement Therefor" filed Feb. 2, 1977, Ser. No. 766,057 and assigned to the assignee of this application.

In accordance with this invention, engine 6 has a vertical crankshaft 13 which extends through opening 8. Pulley 14 is attached to and rotatable with crankshaft 13. The pulley includes two belt grooves 16 and 17.

V-belts 18 and 19 engage grooves 16 and 17, respectively, V-belt 18 provides the motive force to the traction wheels and is reeved on a pulley 21. Belt 19 provides the motive force to the collector assembly and is reeved on a pulley 22. The double groove pulley 14, belts 18 and 19 and pulley 21 are located beneath shroud 7 and within the confines of the spaced vertical walls **3*a* and 3*b* of frame 3. V-belt 19 extends from beneath the shroud through an opening 23 in the side of sidewall 3*a* of the housing. A shroud and belt guard 24 is bolted to the collector assembly housing 5 and shields the belt 19. End wall 26 of the shroud 24 is closely arranged with the V-belt 19 and assists in preventing that V-belt from becoming disengaged from pulley 22** when the belt is not under tension. With this arrangement all of the principal drive elements are shielded from sight and protected.

Pulley 21 is fastened to and rotatable with the input shaft 27 of a traction gear case assembly 28. Through shaft 27 and internal gearing, belt 18 transmits rotational movement to the axle assembly. The interior gearing of gear case 28 is conventional and hence is neither illustrated nor will it be described.

A clutch assembly 29, also of conventional construction is provided in the axle assembly to provide for selective interruption of the drive to the wheels 9. Clutch assembly 29 is controlled by control rods 30, 31, the latter terminating in a handle portion 32 associated with the right handlebar of handle 1. Rotational movement of the handle 32 toward the handlebar causes the clutch 29 to become engaged and the motive force to be transmitted to the left wheel of the snowblower as viewed in the drawings. Upon release of the force on handle 32 it returns to the position of the drawings and clutch 29 is disengaged.

Collector drive pulley 22 is connected to and rotatable with input shaft 33 of a gear case 34 for the collector assembly. Shaft 33 connects with a first bevel gear 36 inside of the housing of the gear case which in turn meshes with a second bevel gear 37. Bevel gear 37 is connected to output shaft 38 which is connected to and rotatable with axle 59 of the collector assembly. In this manner, rotational movement of pulley 22 is transmitted through the gear case to the shaft 39 to rotate the collector assembly.

A pair of flanges 41 and 42 are provided on the gear case housing and are bolted to the end wall 43 of the collector assembly housing by bolts 44. This locates the collector assembly gear case at one axial end of the collector assembly. The opposite axial end of the collector assembly is supported in a bearing assembly 40 attached to sidewall 45 of the collector housing.

A clutch assembly 46 is provided to selectively tension the collector drive belt 19 to complete the drive connection to the collector. More specifically, the clutch mechanism includes an idler pulley 47 supported on a bracket 48 which is in turn mounted for pivotal movement on portion 49 of the frame. Pivotal movement of bracket 48 is achieved through linkage 51 which is connected to control rod 52 and bracket 50. Control rod 52 has a driving engagement with a second control rod 53 so that the two rotate together. The upper end of control rod 53 terminates in a handle 54 associated with the left handlebar of the snowthrower handle. When the handle 54 is depressed into engagement with the left handlebar, control rods 53 and 52 rotate resulting in pivotal movement of bracket 50 which pulls linkage 51 toward the bracket (to the left in the drawing) pivoting bracket 48 clockwise and moving idler pulley 47 into tensioning engagement with belt 19 to complete the drive connection. elease of the force on handle 54 allows pulley 47 to return to the nontensioning position assisted by torsion spring 62. Brake 45 will engage pulley 22 to retard the motion of the collector and bring it to rest, again assisted by torsion spring 62.

Spring 60 in linkage 51 provides lost motion in the connection between bracket 48 and handle 54. Driving tension on belt 19 may be established before handle 54 is in engagement with the handlebar. If not, the operator will have a tendency to move handle 54, all the way into engagement with the handlebar. Spring 60 permits that with unduly tensioning belt 19 and also serves to isolate the handle, and operator, from the continuous feel of the belt tension.

The vertical crankshaft engine permits a relatively inexpensive and yet effective power source to be utilized in the snowthrower. Moreover, the vertical orientation of the crankshaft permits a general horizontal orientation of the major portion of the drive components for the traction wheel and the collector assembly. This permits the elements to be more readily concealed, compactly arranged, and protected from the user for effective safety purposes and from the elements. Also, a side drive to the collector assembly can be used without the need for displacing the engine from a general central location thereby providing a more stable snowthrower. The engine is centered in the snowthrower on a vertical plane extending through the center of the snowthrower parallel to the direction of travel thereof, or in other words bisecting the snowthrower longitudinally.

Gear case 34 is specifically illustrated in the drawings. It will be noted that the gear case housing consists of two halves 56 and 57. The halves are generally complementary and form entire outer housing for the gear case. Snap rings 58, 59, and 61 provide the only force holding the overall subassembly together. When the gear case is finally mounted on the sidewall of the collector assembly housing, securing the bolts 44 provide additional holding forces for the gear case housing. For stability, the gear case is also fastened to the sidewall adjacent the upper end of the gear case, the connection is not shown.

This is a further simplification of the overall power snowthrower drive train assembly.

Although but one embodiment of the present invention has been illustrated and described it will be apparent to those skilled in the art that various changes and modifications may be made therein without departing from the spirit of the invention or from the scope of the appended claims.

We claim:

1. A right angle gear case comprising, in combination, an input shaft, an output shaft arranged at right angles to said input shaft, gear means connecting said input and output shafts, said input and output shafts and said gear means being located within a gear case housing, said gear case housing being characterized in that it is made of two complementary housing portions, and a plurality of snap rings surrounding said housing portions to hold said housing portions assembled.

2. A power snowthrower comprising, in combination, a handle, a collector assembly including a housing, a rotatable collector within said housing, and a generally vertically extending side wall, a frame connecting said handle and said collector assembly, an engine supported on said frame and characterized by including a vertically oriented crankshaft, traction means including an axle attached to said frame and drive wheels supported on said axle, a traction drive member having driving connection with said crankshaft and arranged in a generally horizontal plane, means for connecting said traction drive member to said axle of said traction means to transmit rotational movement thereto, a collector drive member having a driving connection with said crankshaft and arranged in a generally horizontal plane, and means for connecting said collector drive member to said rotatable collector to transmit rotational movement thereto and including a gear case located at one axial end of said collector housing and connected to an axial end of said collector and said gear case connected to and supported on said collector assembly side wall, said gear case being a right angle gear case and comprising an input shaft, an output shaft arranged at right angles to said input shaft, gear means connecting said input and output shafts, said input and output shafts and said gear means being located within a gear housing, said gear case housing being characterized in that it is made of two complementary housing portions, and a plurality of snap rings surrounding said housing portions to hold said housing portions assembled.

3. The snowthrower of claim 2 wherein said gear case housing includes flange means abutting said collector housing side wall, and including fastening means clamping said flange means to said housing side wall.

* * * * *